US006923595B1

(12) United States Patent
Chek

(10) Patent No.: US 6,923,595 B1
(45) Date of Patent: Aug. 2, 2005

(54) VIBRATING TAMPING BULL-FLOAT

(76) Inventor: Paul Edward Chek, 4360 E. Main St., #467, Ventura, CA (US) 93003

( * ) Notice: Subject to any disclaimer, the term of this patent is extended or adjusted under 35 U.S.C. 154(b) by 0 days.

(21) Appl. No.: 10/628,617

(22) Filed: Jul. 28, 2003

(51) Int. Cl.[7] ..... E01C 19/18
(52) U.S. Cl. ..... 404/118; 15/235.4
(58) Field of Search ..... 404/97, 114, 118; 52/749.13; 15/235.4, 235.7, 235.9, 235.8

(56) References Cited

U.S. PATENT DOCUMENTS 2,178,899 A * 11/1939 Shaffer ..... 15/235.7
2,289,248 A 7/1942 Davis ..... 404/97
2,834,199 A * 5/1958 Freeman ..... 15/235.8
4,861,188 A * 8/1989 Rouillard ..... 404/75
5,234,283 A * 8/1993 Adkins ..... 404/97
5,244,305 A * 9/1993 Lindley ..... 404/97
5,393,168 A * 2/1995 Jarvis ..... 404/97
5,417,517 A 5/1995 Zollers ..... 404/97
5,533,831 A * 7/1996 Allen ..... 404/114
6,019,544 A * 2/2000 Emerson et al. ..... 404/104
6,139,217 A * 10/2000 Reuter ..... 404/97
6,379,080 B1 * 4/2002 Saffo, Sr. ..... 404/118
6,695,531 B1 * 2/2004 Prescott ..... 404/118

* cited by examiner

*Primary Examiner*—Robert E. Pezzuto
*Assistant Examiner*—Raymond Addie
(74) *Attorney, Agent, or Firm*—J. E. McTaggart

(57) ABSTRACT

A vibrating tamping bull-float is used for smoothing the top surface of freshly poured concrete, while pushing coarse aggregate down into the concrete while allowing cement cream to surface. Additionally it levels the concrete in the area surrounding the vibrating tamping bull-float. It includes a plurality of float body portions: a stable platform portion and at least one vibrating portion which tamps as you push and pull the vibrating tamping bull-float across the surface of the freshly poured concrete.

10 Claims, 4 Drawing Sheets

VIBRATING TAMPING BULL-FLOAT

FIELD OF THE INVENTION

This invention relates to the field of concrete working equipment, and more particularly to a vibrating tamping bull-float for smoothing the top surface of freshly poured concrete.

DISCUSSION OF PRIOR ART

In the concrete industry there are numerous methods for applying color and surface hardening additives to concrete. The color and hardener application method that is to be discussed herein is the topical application type that is applied after the freshly poured concrete has been roughly leveled to the desired elevation. The topical application method is performed by casting the color or hardener additive onto the top surface of the freshly poured concrete, then the color or hardener additives are worked into the top surface of the fresh concrete by pushing a bull-float or vibrating tamping bull-float such as U.S. Pat. Nos. 2,289,248 and 5,234,283 and 5,417,517 also U.S. Pat. No 6,139,217 over the top of the fresh concrete surface. However this application method for the color additive type is notorious for having discolored chipped areas of cured/hard concrete, which become eyesores. This unsightly concrete is usually found around stamped concrete that has been placed at heavily traveled street intersections and sidewalks. The chipped areas are caused by heavy impact from hard objects. A device that can be used during the bull-float process to allow the color additives to penetrate deeper at a uniform depth so as to not create discoloring (lightly colored areas) to the top surface of the freshly poured concrete, and without adding additional time to the normal working period of the bull-float user. This would be a highly desired item; additionally this device would benefit the hardener additive as well. The benefit lays in the deeper integration of the additives without extending the normal work period of the bull-float user. The prior art referred above is unable to penetrate the color additives deeper into the top surface and provide a consistent shade of color at the top surface of the freshly poured concrete without adding a considerable amount of time to the normal working period.

OBJECTS

It is a primary object of the invention to increase the production of placing and finishing freshly poured concrete by eliminating the conventional method of tamping concrete by hand, thus reducing the physical time it takes to place and finish concrete. It also physically pushes coarse aggregate downward into the top surface of freshly poured concrete while cement cream migrates to the top surface such that a layer of equal or greater quantity of cement cream is deposited at the top surface of the freshly poured concrete, in comparison to the conventional method. It is a further object to level the concrete in a selected area more effectively by producing larger shockwaves/ripples and allowing them to be transmitted farther away from the vibrating tamping bull-float than other single float body vibrating bull-floats, such as U.S. Pat. Nos. 2,289,249 and 5,234,283 and 5,417,517 also 6,139,217. This helps the overall concrete surface area to become more level/flatter as the trailing edge 22 of the vibrating float body 3 moves across the surface of the freshly poured concrete. Another object of this present invention is to enable the user to conveniently turn the drive motor on or off.

SUMMARY OF THE INVENTION

These and other objects are accomplished by providing a vibrating tamping bull-float, which comprise of two float bodies. One of these is used as a stable float body. The other is used for a vibrating tamping float body that pushes coarse aggregate down into the top surface of freshly poured concrete while allowing cement cream to surface and a vibrating means mounted on the two-piece vibrating tamping bull-float body. The two-piece bull-float has a vibrating float body, which is pivotally attached to a stable float body. All of the float bodies are connected together by a hingeable means of attachment, which allows the vibrating float body to pivot from the stable float body while in vibrating mode. When the two-piece vibrating tamping bull-float is being pushed and pulled across freshly poured concrete surface, the vibrating float body physically tamps the coarse aggregate down into the top surface of the freshly poured concrete while allowing cement cream to surface. This levels the concrete in the area surrounding the vibrating tamping bull-float body. This vibrating/tamping process will also benefit cement additive that are required to be integrated into the top surface of the freshly poured concrete. The benefit lays in the deeper integration of the additives.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION

Figure 1:
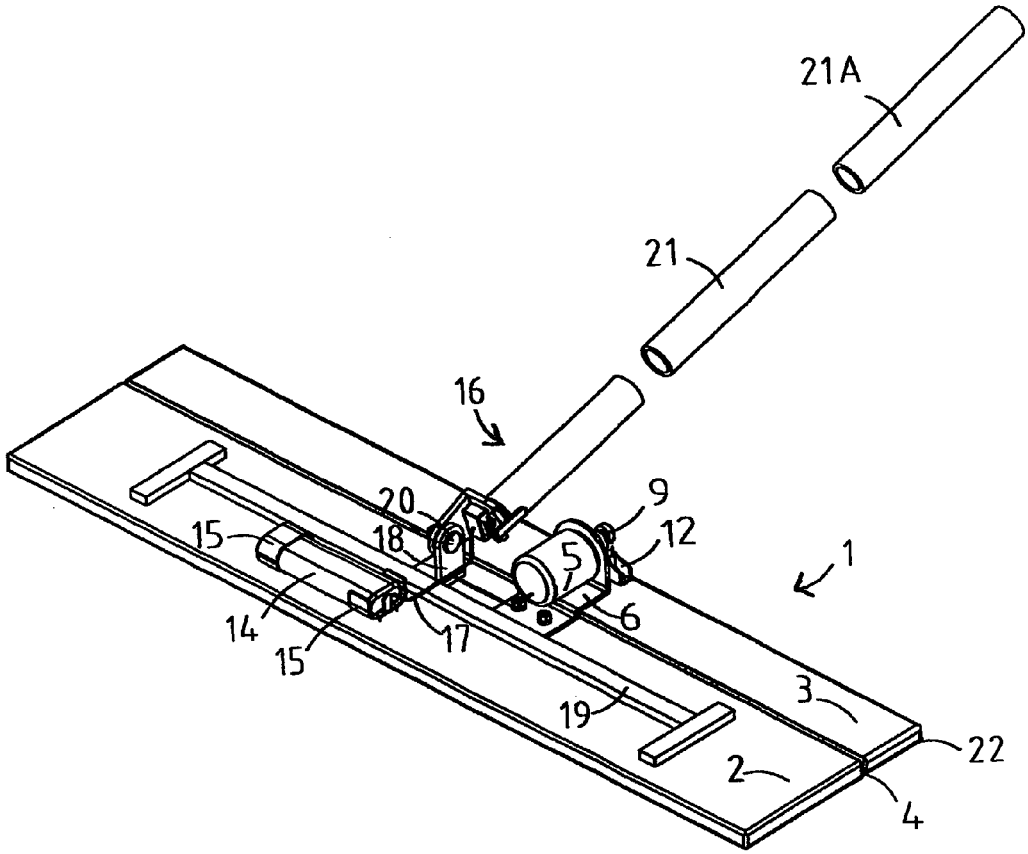
FIG. 1 is a perspective view illustrating the preferred embodiment of the vibrating tamping bull-float constructed in accordance with the principles of the present invention.

FIG. 1 is a perspective view of concrete vibrating tamping bull-float 1 in a primary embodiment of the present invention. Bull-float 1 has a rectangular two-piece body. The first piece is a stable float body 2 pivotally connected to the second piece vibrating body 3 by a continuous hinge 4 or by other means of hingable attachment. Electrical motor 5 is attached to the stable float body 2 by the motor mount 6. A rechargeable battery 14 powers the electrical motor 5. Battery 14 is held in place by a battery holding bracket 15. Said battery bracket 15 is attached to the stable float body 2. An electrical switch mechanism/handle adapter 16 regulates power from the battery 14. A number of vinyl coated electrical copper wires 17 are connected to the battery 14, electric motor 5, and switch/handle adapter 16 in order to complete an electrical circuit. A bull-float handle attachment bracket 18 is connected to a stable float body frame 19. A carriage bolt 20 or by other means of pivotal attachment connects the said handle bracket 18 to the switch/handle adapter 16. The carriage bolt 20 is also used to adjust the switch/handle adapter 16 to the desired angle. The segmented handle 21 is attachable to the switch/handle adapter 16 and is also attachable to a duplicated segmented handle 21A. 22 is a trailing edge of the vibrating float body 3.

Figure 2:
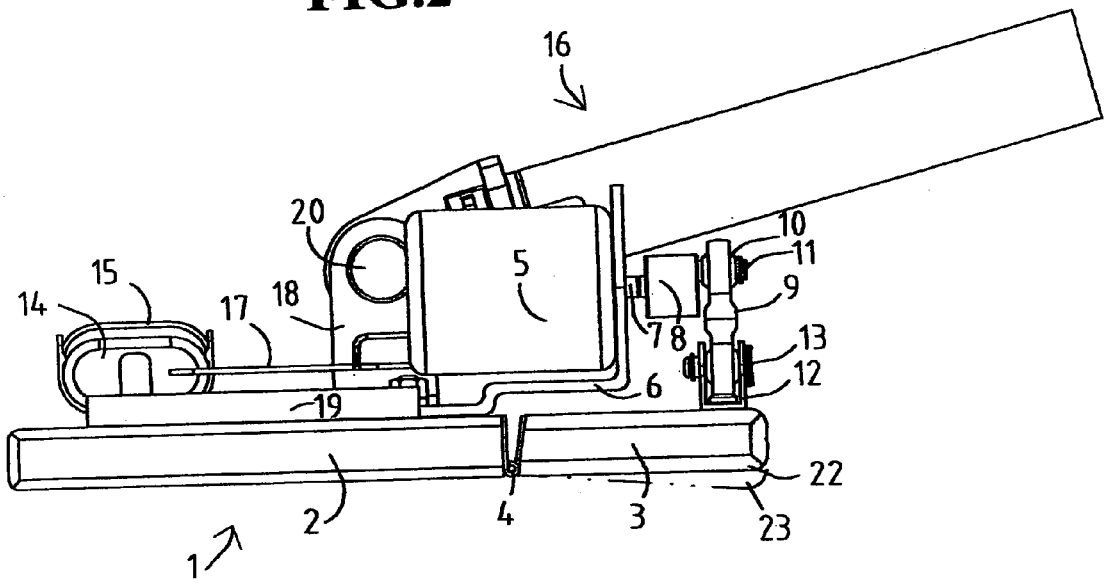
FIG. 2 is an elevation view of side vibrating tamping bull-float shown in FIG. 1.

FIG. 2 is a side elevational view of the bull-float 1 of FIG. 1 showing drive shaft 7 of motor 5 supporting a cam lobe 8 at the end of the drive shaft 7. The cam lobe 8 is pivotally connected to a connecting rod 9 by a cam stud 11 the connecting rod 9 has spherical bearings 10 at each end. The vibrating float body 3 is connected to the connecting rod 9 by a connecting rod mounting bracket 12 they are held together by a connecting pin 13. Broken line 23 indicates vertical movement of a trailing edge while in vibrating/tamping mode.

Figure 3:
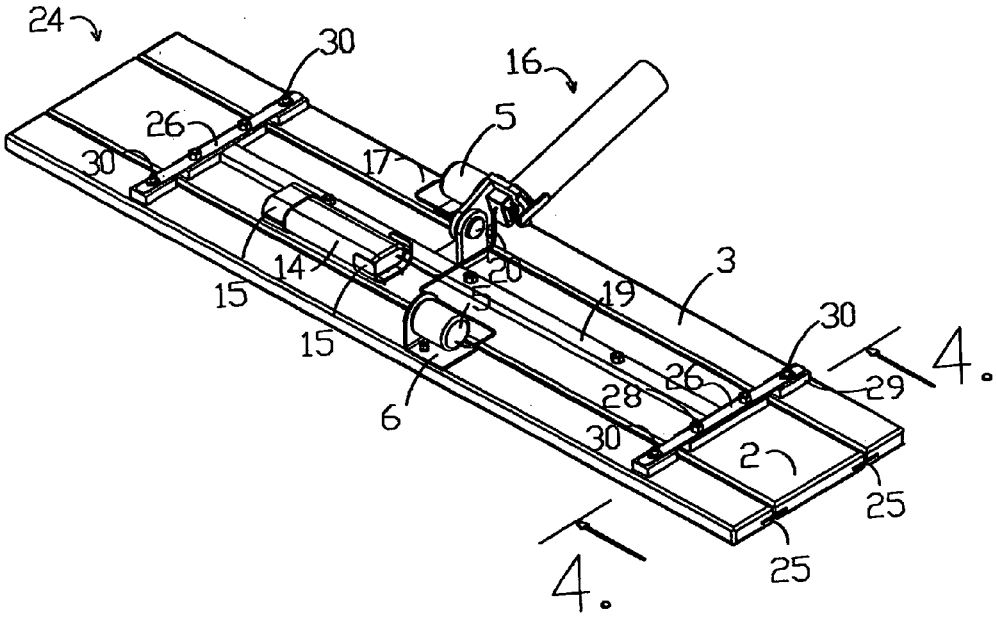
FIG. 3 is a perspective view illustrating an alternate version of a three piece vibrating tamping bull-float body.
Figure 4:
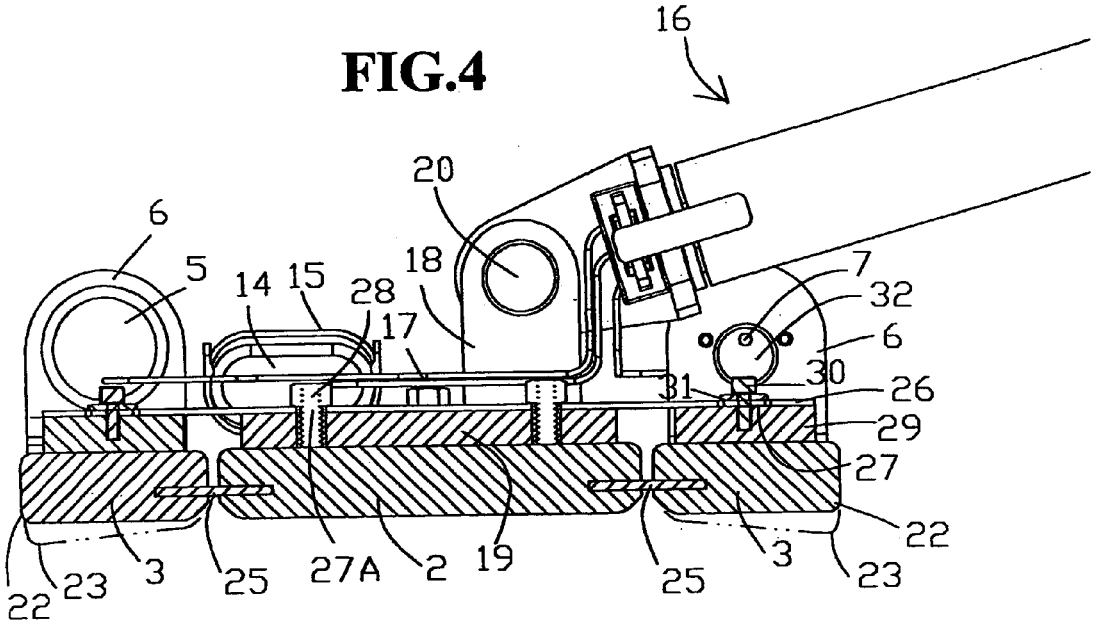
FIG. 4 is a section view of the alternate version of the three piece vibrating tamping bull-float body

FIG. 3 is a perspective view of an alternative embodiment of the present invention wherein the three-piece float body 24 it is comprised of one stable float body 2 and two vibrating float bodies 3. The longitudinal side, along each vibrating tamping float bodies are connected to the stable float body along both longitudinal narrow sides by strips of resilient material 25 or by other means of hingeable attachment. The vibrating tamping float bodies are held in a Simi-stable position by leaf-springs 26 there is an elongated hole 27 at each end of the leaf springs end there are round holes 27A in FIG. 4 that are used to allow bolts 28 to firmly attach the leaf-springs 26 to the stable float body frame 19. A vibrating float body frame 29 is firmly attached to the vibrating float body 3. A holding pin 30 is connected to the vibrating float frame 29. A washer-bushing 31 in FIG. 4 is positioned between the head of a holding pin 30 and the elongated hole 27 in FIG. 4. The leaf-spring 26 is allowed to move freely between the washer-bushing 31 and the vibrating float frame 29, The free movement of the leaf spring 26 allows the trailing edge 22 to move vertically 23 wile in vibrating mode and to return to Simi-stable position when out of vibrating mode. The two electric motors 5 that have eccentric weights 32 in FIG. 4 are attached at the end of the motors drive shaft 7. The electric motors 5 are attached to the motor mounts 6. The motor mounts are attached to each vibrating float body 3. The electric motors 5 are powered by the rechargeable battery 14. The battery 14 is held in place by the battery bracket 15. The battery bracket 15 is attached to the stable float body 2. The switch/handle adapter 16 regulates power from the battery 14. The electrical wires 17 are connected to the battery 14, electric motor 5, and the switch/handle adapter 16 in order to complete an electrical circuit. The bull-float handle attachment bracket 18 is connected to the stable float body frame 19. The carriage bolt 20 or by other means of pivotal attachment connects the handle bracket 18 to the switch/handle adapter l6. The carriage bolt 20 is also used to adjust the switch/handle adapter 16 to the desired angle. The segmented handle 21 can be attachable to the switch/handle adapter 16 and is also attachable to a duplicated segmented handle 21A. 22 is the trailing edge of the vibrating float body 3. 23 illustrate the vertical movement of the trailing edge while in vibrating mode.

FIG. 4 is a sectional side view of bull-float 24 of FIG. 3 showing the elongated hole 27 and the round hole 27A in the leaf-spring. 31 is the washer-bushing. 32 is the eccentric weight that is attached to drive shaft.

Figure 5:
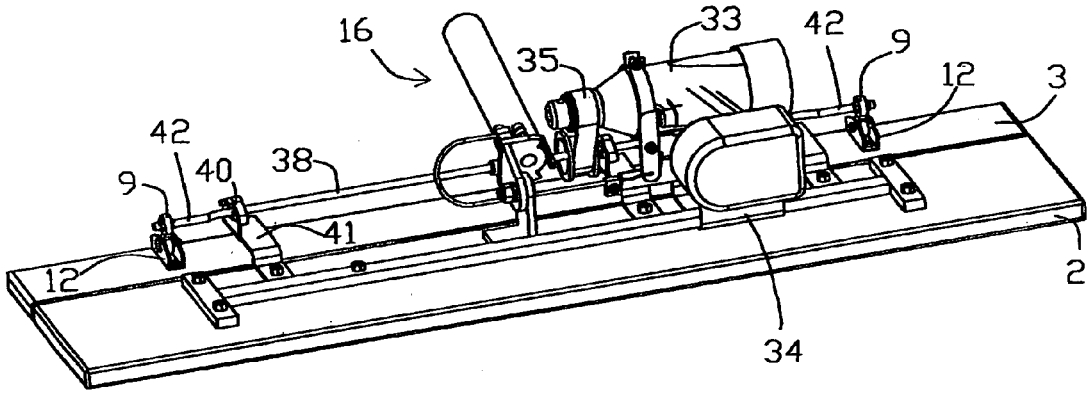
FIG. 5 is a perspective view illustrating the alternate drive system for the vibrating tamping bull-float

FIG. 5 is a perspective view illustrating the alternate drive system showing an elongated two-piece bull-float body 1. The first piece is the stable float body 2 it is pivotally connected to the vibrating/tamping float body 3 by the continuous hinge 4 or by other means of hingable attachment. The battery powered drill motor 33 is firmly attached to a universal drill motor mount 34. The drill motor mount 34 is attached to the stable float body 2. A drive belt 35 is used to convey rotational energy from a chuck housing/drive Polly 36 to a shaft Polly 37. A shaft 38 is held in place by three main bearings 39 they are inserted in a bearing housing 40. The bearing housing 40 is attached to a main bearing/cantilever bracket 41. The bearing bracket 41 is mounted to the stable float body 2. One end of the connecting rod 9 is connected to crank end of the shaft 42. The other end of the connecting rod 9 is connected to the connecting rod bracket 12.

Figure 6:
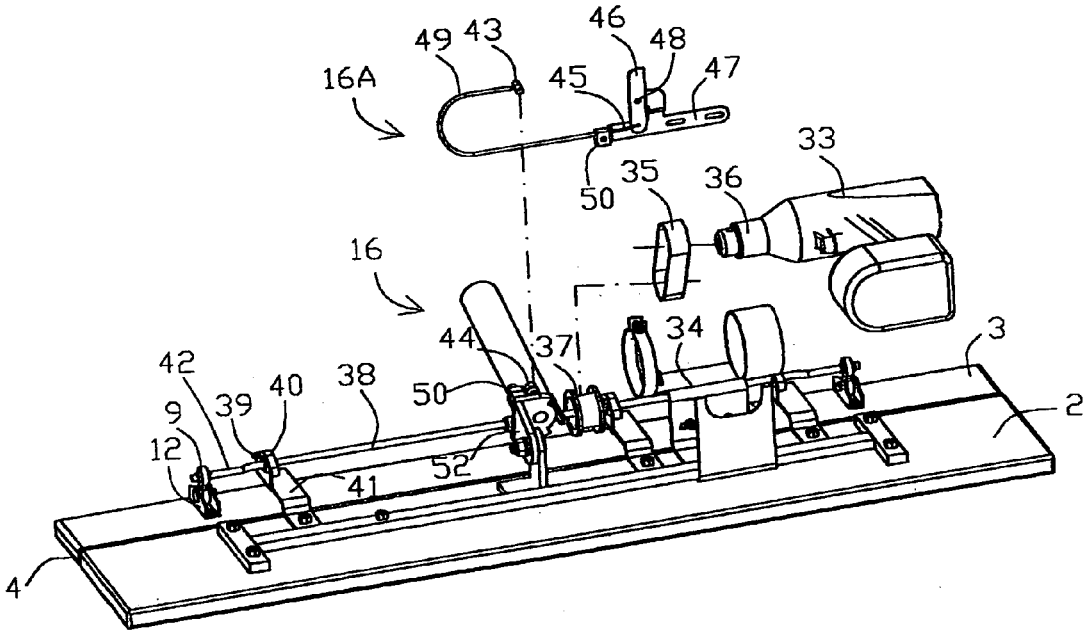
FIG. 6 is a partially exploded view of the alternate drive system of the vibrating tamping bull-float in FIG. 5.

FIG. 6 is a partially exploded view of the drive system of the bull-float in FIG. 5 showing the switch/handle adapter 16 with a alternate throttle cable assembly 16A. A throttle cable pin end 43 is held in place by a pin housing bracket 44. The opposite end of the throttle cable 45 is attached to a trigger lever 46. The said trigger lever 46 is connected to a adjustable trigger bracket 47 at a pivoting point 48 of the trigger lever 46. One end of a cable housing 49 is attached to the said adjustable bracket 47 and is held in place by a cable housing holding bracket 50. The opposite end of the cable housing 49 is connected to an axial-base mounting bracket 52 of the switch/handle adapter 16 and is also held in place by the housing bracket 50.

Figure 7:
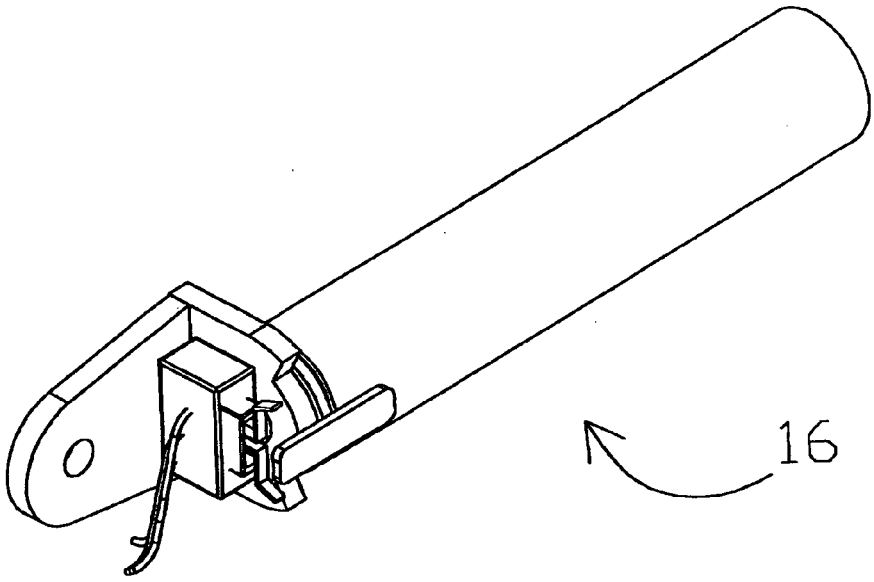
FIG. 7 is a perspective view of an assembled electrical switch mechanism/handle adapter

FIG. 7 is a perspective view of an assembled version of the electrical switch mechanism/handle adapter 16.

Figure 8:
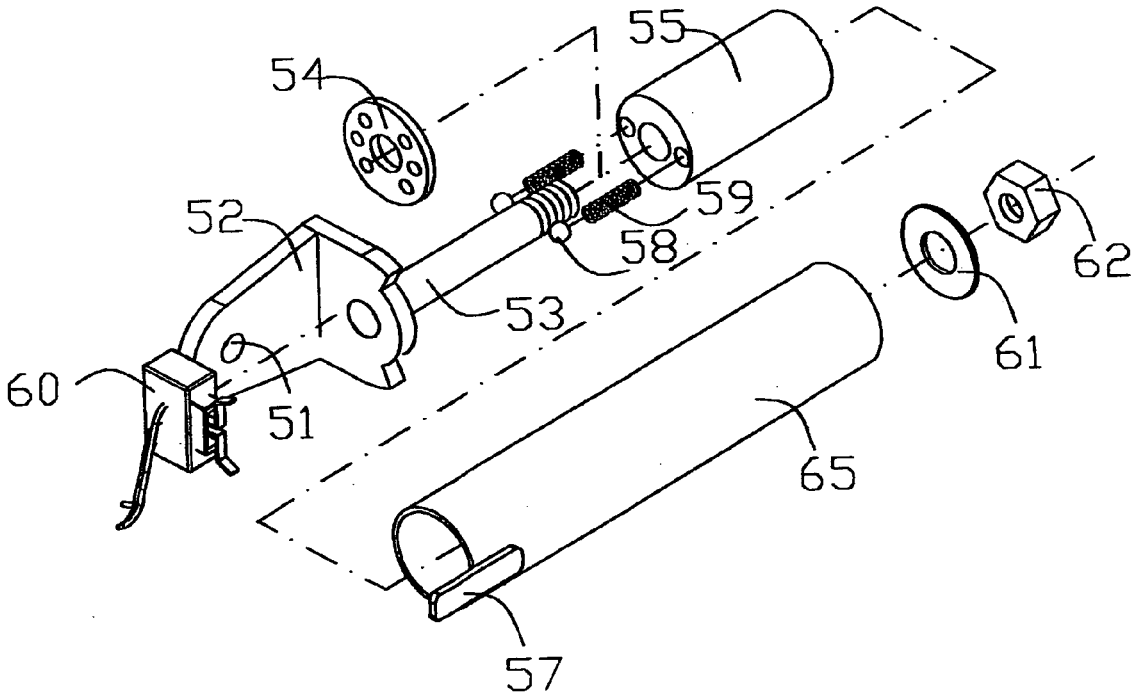
FIG. 8 is an exploded view of the electrical switch mechanism/handle adapter shown in FIG. 7

FIG. 8 is an exploded view of the electrical switching mechanism/handle adapter 16 of FIG. 7 showing the pivoting hole 51 of the axial-mounting bracket 52. The axial bracket 52 supports a spindle axial 53. A Simi-locking bearing seating plate 54 is firmly attached to the axial bracket 52. A handle adapter sleeve insert 55 is positioned in side a handle adapter sleeve 56 at a toggle switch/switching tab 57 end, and locked together. A Simi-locking bearing 59 and the tensioning spring 58 are housed in side said sleeve insert 55. An electrical toggle switch 60 can be turned on or off as the switch tab 57 is rotated along with the handle adapter sleeve 56 to the desired Simi-locking position. A bushing washer 61 is positioned between the sleeve insert 55 and the tensioning nut 62. The tensioning nut 62 is connected to the end of the spindle axial 53.

The stable float body 2 helps prevent the vibrating tamping bull-float 1 in FIG. 1 from submerging into freshly poured concrete while the vibrating float body 3 transmits larger shockwaves from the trailing edge 22. The tamping motion 23 of the vibrating float body 3 along the trailing edge 22 generates these shockwaves/ripples. This helps the overall concrete surface area to become more level/flatter as the trailing edge 22 of the vibrating float body 3 moves across the surface of the freshly poured concrete. This helps the user by reducing the amount of times they must repeat the vibrating tamping bull-floating cycle over the same path. This is caused by not leveling the concrete surface enough during the first cycle. A vibrating tamping bull-floating cycle is performed by turning on a means of vibration to the vibrating float body 3 while pushing the vibrating tamping bull-float 1 in FIG. 1 across the freshly poured concrete surface. A user would turn off the means of vibration to the vibrating float body 3 before returning in an ordinary bull-float method of floating. The trailing edge 22 moves up and down 23 when the two piece vibrating tamping bull-float is turned on, the up and down motion 23 in FIG. 2, also helps dry shake color hardeners to integrate deeper into the top surface of the freshly poured concrete, versus the conventional method of bull-floating with a single body vibrating bull-float. The stable float body 2 helps prevent the vibrating tamping bull-float 1 in FIG. 1 from submerging into freshly poured concrete while the vibrating float body 3 transmits larger shockwaves from the trailing edge 22. The tamping motion 23 of the vibrating float body 3 along the trailing edge 22 generates these shockwaves/ripples. by applying torsion pressure anywhere along the longitudinal axis of the segmented handle 21 or segmented handles without having to reach away from said handle or handles to turn the drive motor on or off. The torsion pressure is applied by the natural wrist movement of the operator during the vibrating tamping bull-float cycle, which is a desired feature.

A further discussion of various designs of the present invention that are not shown in the drawings, such as:

A two-piece float body comprising of two vibrating float bodies of equal width. These float bodies are arranged so that one would vibrate and the other vibrating float body would become a stable float body when not in use and vica-verca. Another design of the float bodies are arranged so that the vibrating float body moves vertically up and down in a level position (not pivoting) parallel to the stable float body.

The invention may be embodied and practiced in other specific forms without departing from the spirit and essential characteristics thereof. The present embodiments are therefore to be considered in all respects as illustrative and not restrictive. The scope of the invention being indicated by the appended claims rather than by the foregoing description; and all variations. Substitutions and changes which come within the meaning and range of equivalency of the claims are therefore intended to be embraced therein

What is claimed is:

1. A vibrating/tamping bull-float for agitating, leveling and smoothing a top surface of freshly poured concrete, integrating cement adhesives into the top surface, and pushing coarse aggregate down into the concrete while allowing cream to surface, comprising:

a stable float body with a horizontally extending bottom surface, attached to said pushing handle;

a vibrating float body with a horizontally extending bottom surface, pivotally attached to said stable float body at a primary axis of flexure extending along a primary longitudinal edge thereof and disposed parallel thereto;

an actuator mechanism made and arranged to vibrate said vibrating float body about the axis of flexure and thus tamp the cement; and a pushing handle, attached to said stable float body; made and arranged to enable a user to move the bull-float back and forth on the concrete so as to agitate the top surface of the concrete in a tamping manner to level uneven concrete elevations of the top surface of the concrete, integrate cement adhesives into the top surface of the concrete, and cause cement cream to migrate to the top surface while the coarse aggregate is being pushed downward into the concrete.

2. The vibrating/tamping bull-float as defined in claim 1 further comprising a bracket mounted on said stable float body made and arranged to receive attachment of said pushing handle.

3. The vibrating/tamping bull-float as defined in claim 2 wherein said bracket is made and arranged to swivel in a manner to provide a variable angle between said stable float body and said pushing handle and thus enable the user to move said float bodies back and forth on the concrete.

4. The vibrating/tamping bull-float as defined in claim 1 further comprising:

a second vibrating float body with a horizontally extending bottom surface, pivotally attached to said stable float body at a second axis of flexure extending along a second longitudinal edge thereof disposed opposite the primary longitudinal edge and parallel thereto, and said actuator mechanism being made and arranged to vibrate said second vibrating float body about the second axis of flexure, in addition to vibrating said primary vibrating float body so as to further enhance tamping performance of the bull-float in pushing the coarse aggregate down into the concrete while allowing the cream to surface.

5. The vibrating/tamping bull-float as defined in claim 1 wherein said actuator mechanism comprises:

an electric motor having a drive shaft;

a mounting bracket attaching said electric motor to said vibrating float body; and an eccentric mass affixed to the drive shaft of the motor, made and arranged to transmit a desired amplitude of vibration to said vibrating float body in response to rotation of said drive shaft.

6. The vibrating/tamping bull-float as defined in claim 1 wherein said actuator mechanism comprises:

an electric motor;

a mounting bracket attaching said electric motor to said stable float body;

a shaft rotationally coupled to said electric motor, located above said vibrating float body, extending to two opposite end regions thereof; and at each end of said shaft, an eccentric mechanism made and arranged to vibrate said vibrating float body about the axis of flexure in response to rotation of said camshaft.

7. The vibrating/tamping bull-float as defined in claim 6 wherein said electric motor is an electric hand-drill motor.

8. The vibrating/tamping bull-float as defined in claim 5 further comprising an on-board rechargeable battery made and arranged to power said electric motor.

9. The vibrating/tamping bull-float as defined in claim 6 further comprising an on-board rechargeable battery made and arranged to power said electric motor.

10. The vibrating/tamping bull-float as defined in claim 1 wherein said pushing handle is configured in a segmented manner enabling assembly and deployment in any selected one of a plurality of predetermined different lengths.

* * * * *